US009589760B2

(12) United States Patent
Miyaoka et al.

(10) Patent No.: US 9,589,760 B2
(45) Date of Patent: Mar. 7, 2017

(54) X-RAY GENERATOR

(71) Applicant: SHIMADZU CORPORATION, Kyoto-shi, Kyoto (JP)

(72) Inventors: Akihiro Miyaoka, Kyoto (JP); Tomomi Tamura, Kyoto (JP); Hiroki Maeda, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 134 days.

(21) Appl. No.: 14/501,727

(22) Filed: Sep. 30, 2014

(65) Prior Publication Data

US 2015/0103979 A1 Apr. 16, 2015

(30) Foreign Application Priority Data

Oct. 16, 2013 (JP) ..... 2013-215585

(51) Int. Cl.
*H05G 1/02* (2006.01)
*H01J 35/18* (2006.01)

(52) U.S. Cl.
CPC ..... *H01J 35/18* (2013.01); *H01J 2235/122* (2013.01); *H01J 2235/1291* (2013.01); *H01J 2235/183* (2013.01); *H01J 2235/186* (2013.01)

(58) Field of Classification Search
CPC ..... H01J 35/18; H01J 5/18; H01J 2235/183; H01J 2235/18; H01J 33/04
See application file for complete search history.

(56) References Cited

U.S. PATENT DOCUMENTS 4,731,804 A 3/1988 Jenkins
6,005,918 A * 12/1999 Harris ..... H01J 35/18 378/140

(Continued)

FOREIGN PATENT DOCUMENTS

JP 4-144045 A 5/1992
JP 2004-111336 A 4/2004

OTHER PUBLICATIONS

Communication dated May 30, 2016, from the State Intellectual Property Office of the P.R.C., in counterpart Chinese application No. 20140509911.7.

(Continued)

*Primary Examiner* — Hoon Song
(74) *Attorney, Agent, or Firm* — Sughrue Mion, PLLC

(57) ABSTRACT

An object of the invention is to provide an X-ray generator having a simple configuration where heat generated in the irradiation window can be prevented from conducting to a desired portion in accordance with the purpose of use, the method of use or the structure of the X-ray tube. In an X-ray generator for releasing X-rays generated by irradiating a target placed in a vacuumed atmosphere within an X-ray tube with an electron beam from an electron source through an irradiation window of the X-ray tube, the irradiation window has thermal anisotropy where the thermal conductivity is different between the direction in which the irradiation window spreads and the direction of the thickness of the irradiation window, and therefore, the thermal conductivity in the direction in which the heat from the irradiation window is desired not to conduct is made relatively smaller.

7 Claims, 8 Drawing Sheets

(56) References Cited

U.S. PATENT DOCUMENTS

| | | | | |
|---|---|---|---|---|
| 6,594,341 | B1 * | 7/2003 | Lu | H01J 35/18<br>378/140 |
| 2004/0125919 | A1 | 7/2004 | Martinez et al. | |

OTHER PUBLICATIONS

Communication dated Dec. 2, 2016, from the State Intellectual Property Office of People's Republic of China in counterpart Application No. 201410509911.7.

* cited by examiner

X-RAY GENERATOR

This application claims priority from on Japanese Patent Application No. 2013-215585 filed Oct. 16, 2013, the contents of all of which are incorporated herein by reference in their entirety.

BACKGROUND OF THE INVENTION

1. Field of the Invention

The present invention relates to an X-ray generator to be used for an X-ray inspection device for industrial or medical use, or various types of X-ray spectrometers or measuring devices using the diffraction or refraction of X-rays, and in particular to an X-ray generator in a system where X-rays are generated by making electrons collide with a target in a vacuumed atmosphere within an X-ray tube.

2. Description of Related Art

In X-ray generators, excluding special ones, a target and an electron source are placed within an X-ray tube that has been vacuumed, and electrons generated by the electron source are accelerated and made to collide with a target as an electron beam so that X-rays are generated. The generated X-rays are taken outside through an irradiation window that air tightly seals the inside of the X-ray tube from the outside.

Due to the difference between X-ray tubes in the means for holding a target, irradiating an electron beam, or taking out X-rays, the structure of the X-ray tube in the vicinity of the irradiation window is categorized as a transmission type or a reflection type as shown in the schematic diagrams of FIGS. 10 and 11.

In FIG. 10 showing a transmission-type X-ray tube, 101 is a target holder provided in an end portion of the X-ray tube, and 102 is a target where the target 102 is layered on the inside of an irradiation window 103, and thus formed so as to be integrated with the irradiation window 103. In this transmission-type X-ray tube, X-rays are generated from an X-ray generating point 102*a*, which is a spot on the target 102 to be irradiated with an electron beam, when the target 102 is irradiated with an electron beam B so that the X-rays are released to the outside through the irradiation window 103 mainly in the direction DT that is the same as the direction in which the electron beam B progresses.

Meanwhile, in FIG. 11 showing a reflection-type X-ray tube, 201 is a target holder, 202 is a target, and 203 is an irradiation window. X-rays are generated from an X-ray generating point 202*a*, which is a spot on the target 202 to be irradiated with an electron beam, when the target 202 is irradiated with an electron beam B so that the X-rays are released to the outside through the irradiation window 203 that makes contact with a target holder portion with an opening provided in the direction DR in which X-rays are taken out.

In both of the above-described transmission-type and reflection-type X-ray tubes, light metals such as Be or Al are used as the material of the irradiation windows 103 and 203.

Incidentally, the energy of the X-rays generated on the target is approximately 1% of the energy of the electron beam that strikes the target, and thus, the remaining 99% is converted to thermal energy. As a result, the temperature of the target 102 in the transmission-type X-ray tube shown in FIG. 10 becomes high, and therefore, the temperature of the irradiation window 103 that is integrated with the target 102 also becomes high.

Meanwhile, in the reflection-type X-ray tube shown in FIG. 11, the irradiation window 203 is not easily affected by the heat released from the target 202. However, the irradiation window 203 generates heat when the electron beam B reflected from the target 202 strikes it.

When the temperature of the irradiation window of the X-ray tube becomes high, it may cause various problems such as a gas released into the vacuumed atmosphere within the X-ray tube, a load on a brazed portion in a vacuum due to thermal stress, or a thermal effect in the case where the object to be inspected approaches the irradiation window from the air side.

Therefore, various means for suppressing the increase in the temperature of the irradiation window have been provided according to the prior art. For example, the irradiation window or its periphery are water-cooled or air-cooled, or such a structure is adopted that the target in a transmission-type X-ray tube makes close contact with a diamond, which is a material with excellent thermal conductivity, so that the heat is led to a heat radiator (see Patent Document 1). In a reflection-type X-ray tube, such a structure is adopted that a shield member is provided within the X-ray tube so as to prevent the electron beam reflected from the target from colliding with the irradiation window (see Patent Document 2).

In the case where a material with poor thermal conductivity is adopted as the material of the irradiation window, which is not usual, the point irradiated with the electron beam easily reaches the melting point in a vacuum.

PRIOR ART DOCUMENTS

Patent Documents

Patent Document 1: Japanese Unexamined Patent Publication H4 (1992)-144045

Patent Document 2: Japanese Unexamined Patent Publication 2004-111336

SUMMARY OF THE INVENTION

1. Problem to be Solved by the Invention

In order to prevent the temperature of the irradiation window from rising in the X-ray tube, it is most effective to reduce the intensity of the electron beam that strikes the irradiation window, which is the basic cause of heat generation. In a transmission-type X-ray tube, however, a reduction in the intensity of the electron beam means a reduction in the amount of generated X-rays, which affects the performance of the device.

In the case where the irradiation window is forcefully cooled by water or air, the space and cost for it are required. The technology disclosed in Patent Document 2, where a member for shielding electrons is provided in a reflection-type X-ray tube, also requires space and cost for the member to be placed within the X-ray tube.

Furthermore, an increase in the temperature can be reduced by modifying the irradiation window itself. For example, the irradiation window can be made thicker so that the thermal capacity is increased and the transfer of heat to the periphery is made easier, and thus, an increase in the temperature can be expected to be reduced. In the case of X-ray tubes used for non-destructive inspection, however, such a problem arises that the maximum enlargement ratio (magnification ratio of a radiograph) becomes smaller as the distance between the X-ray generating point (X-ray focal point) and the object to be inspected is increased in order to project an enlarged image of the object to be inspected. Such a problem also arises that the amount of X-rays absorbed by the irradiation window increases, and thus, the amount of X-rays that can be used effectively is reduced.

In the technology disclosed in Patent Document 1 where the heat is led to a heat radiator by making the target make close contact with a material having excellent thermal conductivity, the same problem as above where the magnification ratio is affected arises because the heat radiator protrudes from the target to the side in which X-rays are irradiated, and the irradiation window is provided in its end portion. When a material with excellent thermal conductivity is used for the irradiation window, an increase in the temperature in a local portion of the irradiation window can be suppressed. However, heat conducts uniformly throughout the irradiation window, and therefore, it is possible for the thermal effects on the object to be inspected to be greater when the object to be inspected approaches from the air side in order to increase the magnification ratio of the radiograph.

The present invention is provided in view of the above-described situations, and an object thereof is to provide an X-ray generator having a compact configuration where heat generated in the irradiation window can be prevented from conducting to a desired portion in accordance with the purpose of use, the method of use or the structure of the X-ray tube.

2. Means for Solving Problem

In order to achieve the above-described object, the X-ray generator according to the present invention is an X-ray generator for releasing X-rays generated by irradiating a target placed in a vacuumed atmosphere within an X-ray tube with an electron beam from an electron source to the outside of the X-ray tube through an irradiation window that air tightly seals an opening provided in the above-described X-ray tube, and is characterized in that the above-described irradiation window has thermal anisotropy where the thermal conductivity is different between the direction in which the irradiation window spreads and the direction of the thickness of the irradiation window.

In the present invention, either the structure where the thermal conductivity in the direction in which the irradiation window spreads is smaller than the thermal conductivity in the direction of the thickness of the irradiation window or the structure where the thermal conductivity in the direction in which the irradiation window spreads is greater than the thermal conductivity in the direction of the thickness of the irradiation window can be selected for the above-described irradiation window.

Concretely, an irradiation window made of a thermally anisotropic material, more concretely, an irradiation window made of a thermally anisotropic graphite can be used as the irradiation window in the present invention.

Furthermore, a multilayer material where materials having different thermal conductivities are alternately layered on top of each other can be used as another material for the irradiation window in the present invention.

Though the present invention can be applied to X-ray generators using either X-ray tube, transmission-type or reflection-type, the working effects are especially large when the invention is applied to a transmission-type X-ray tube where a target material is layered on top and integrated with the surface of the irradiation window on the inside of the X-ray tube.

An object of the present invention is achieved by providing thermal anisotropy to the irradiation window so that the main direction in which the heat conducts from the irradiation window is set. An object having thermal anisotropy is an object having different thermal conductivities depending on the direction of the object. In the case of an object in plate form, for example, the thermal conductivity is different between the direction of the thickness of the object and the direction in which the object spreads.

That is to say, less heat is conducted in a desired direction when an irradiation window having thermal anisotropy is provided so that the direction in which the thermal conductivity is smaller is matched with the desired direction. For example, the thermal conductivity in the direction in which the irradiation window spreads can be made smaller than the thermal conductivity in the direction of the thickness of the irradiation window so that the heat generated by the collision of electrons with the irradiation window mainly conducts in the direction of the thickness of the irradiation window, and thus is released to the air in the direction towards the air side. As a result, the heat can be prevented from conducting to the inside of the X-ray tube, and thus, the load on the brazed portions in the vacuum due to thermal stress and the load on the O ring for air tightly sealing the irradiation window can be reduced.

Conversely, the heat from the irradiation window mainly conducts in the direction in which the window spreads when the thermal conductivity in the direction in which the irradiation window spreads is greater than the thermal conductivity in the direction of the thickness of the irradiation window. In this case, heat can be prevented from conducting from the irradiation window to the air side, and thus, thermal effects can be reduced when the object to be inspected approaches the irradiation window.

The above-described irradiation window having thermal anisotropy can be implemented by using a thermally anisotropic material such as graphite. In addition, an irradiation window where the thermal conductivity in the direction in which the irradiation window spreads is greater than that in the direction of the thickness of the irradiation window can also be implemented by layering materials having different thermal conductivities on top of each other. That is to say, an irradiation window where good thermal conductors and poor thermal conductors are layered on top of each other allows heat to conduct throughout each layer of the good conductors while making it difficult for heat to conduct through the adjacent layers of poor conductors. As a result, the thermal conductivity in the direction of the thickness of the irradiation window is relatively smaller so that heat mainly conducts in the direction in which the irradiation window spreads, and thus, thermal anisotropy is achieved on the whole.

3. Effects of the Invention

According to the present invention, the irradiation window of the X-ray tube has thermal anisotropy, and therefore, the direction in which the heat from the irradiation window mainly conducts can be regulated to a specific direction in accordance with the purpose or the structure of the X-ray tube. In the case where the brazed portions in the X-ray tube are desired to be prevented from being affected by thermal stress, for example, an irradiation window where the thermal conductivity in the direction in which the irradiation window spreads is smaller than the thermal conductivity in the direction of the thickness of the irradiation window can be used so as to lead heat mainly to the air side. In the case where an object to be inspected is desired to be less affected by heat in the X-ray tube for the purpose of gaining a radiograph of an enlarged image by making the object to be inspected approach the X-ray focal point, an irradiation window where the thermal conductivity in the direction in which the irradiation window spreads is greater than the thermal conductivity in the direction of the thickness of the irradiation window can be used to lead the heat mainly to the X-ray tube side. As described above, the X-ray tube can be fabricated based on the selection of the type of irradiation window in accordance with the portion to which it is desired to prevent heat from conducting.

In addition, it is not particularly necessary to add a member for suppressing heat conduction according to the present invention, and thus, the space for this is not necessary, and therefore, the structure can be made compact. Naturally, a member for conducting heat may be used together in order to further increase the cooling efficiency.

DETAILED DESCRIPTION OF EMBODIMENTS

In the following, embodiments of the present invention are described in reference to the drawings.

Figure 1:
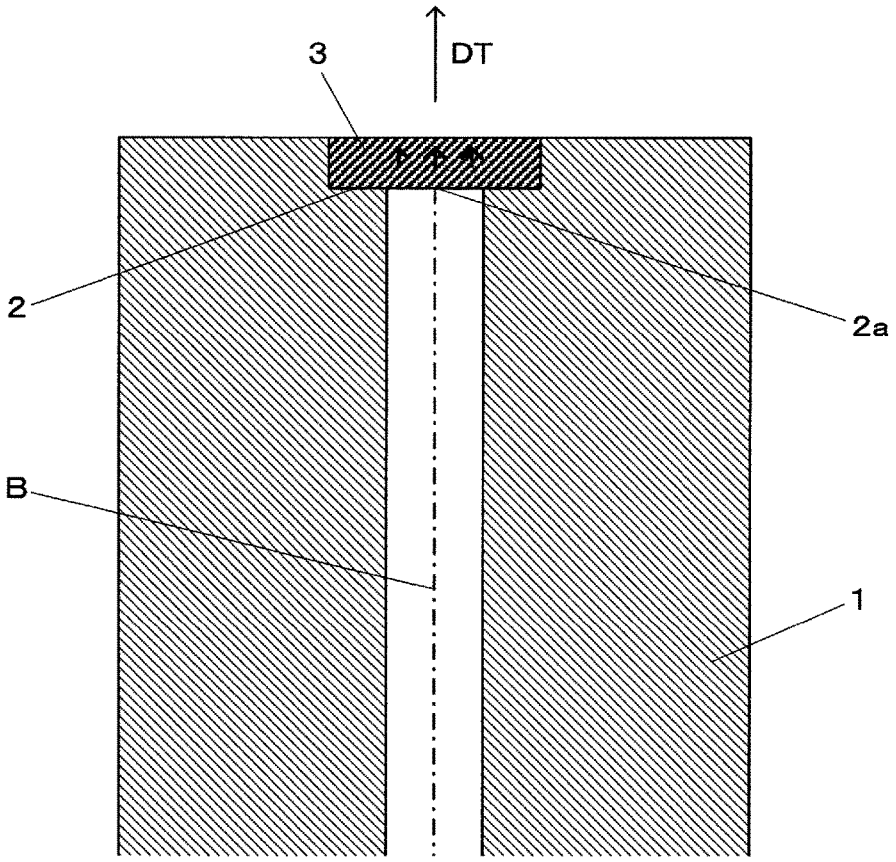
FIG. 1 is a schematic cross-sectional diagram showing the structure in the vicinity of the irradiation window of the X-ray tube where heat conduction to the target holder is suppressed according to an embodiment of the present invention.

FIG. 1 is a schematic cross-sectional diagram showing the irradiation window of the X-ray tube and its vicinity according to an embodiment of the present invention, which is an example of the structure for preventing heat from the irradiation window from conducting to the X-ray tube (target holder) side.

Figure 10:
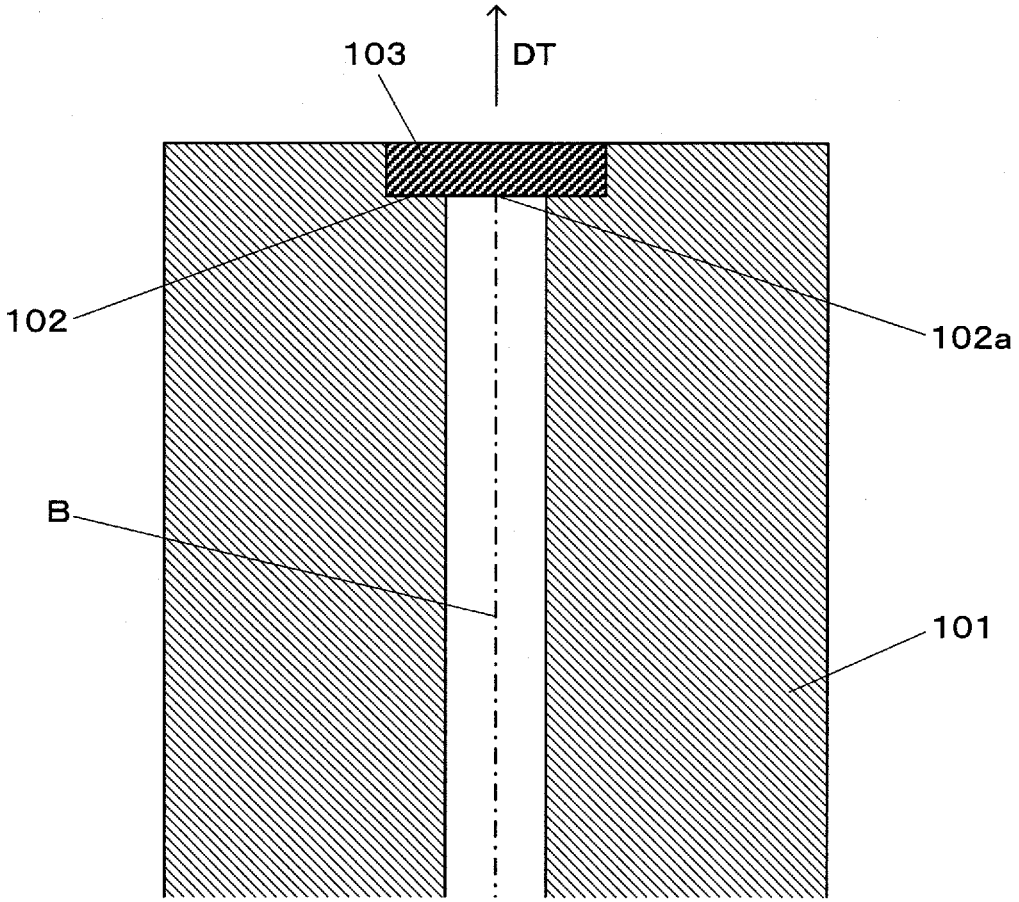
FIG. 10 PRIOR ART
FIG. 10 is a schematic cross-sectional diagram showing an example of the structure in the vicinity of the irradiation window of a transmission-type X-ray tube according to the prior art.

The example in FIG. 1 basically has the same structure as that in FIG. 10, and a target holder 1 provided in an end portion of an X-ray tube that has been vacuumed air tightly holds an irradiation window 3 on the inside of which a target 2 is layered so as to be integrated. In addition, an electron source made of a filament or the like (not shown) is placed within the X-ray tube. When an electron beam B generated by converging and accelerating electrons from this electron source strikes the target 2 integrated with the irradiation window 3, X-rays are generated at an X-ray generating point 2*a,* which is the spot at which the electron B strikes the target 2. The generated X-rays are released out of the X-ray tube mainly in the direction DT that is the same direction in which the electron beam B progresses.

Figure 2:
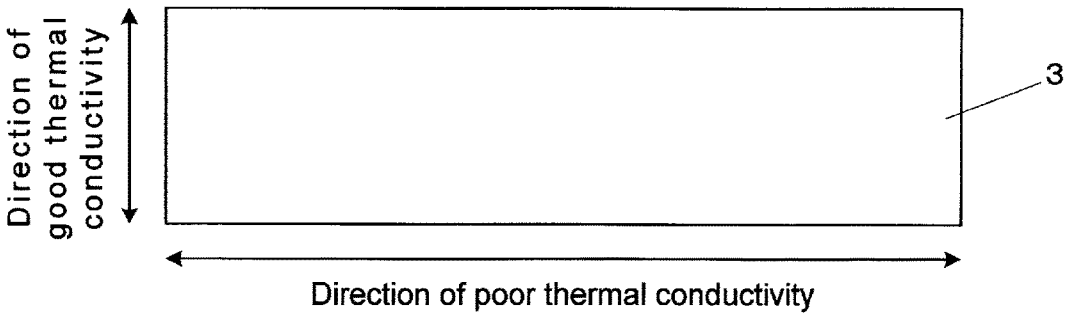
FIG. 2 is a diagram for illustrating a way for heat to conduct through the irradiation window in FIG. 1.

This example is characterized in that the irradiation window 3 is formed of a thermally anisotropic material, for example, thermally anisotropic graphite. As shown in FIG. 2, the way for heat to conduct is characterized in that the thermal conductivity in the direction in which the irradiation window 3 spreads (direction perpendicular to the electron beam B) is smaller than the thermal conductivity in the direction of the thickness of the irradiation window 3 (the same direction as the electron beam B). That is to say, the majority of the heat that has been transferred from the target 2 to the irradiation window 3 conducts in the direction of the thickness of the irradiation window 3.

As described above, the energy of the X-rays generated on the target 2 is approximately 1% of the energy of the electron beam B that has struck the target 2, and the remaining 99% is converted to thermal energy. In this type of X-ray tube, the target 2 is usually a thin film of several μm, and the heat generated on the target 2 is transferred to the irradiation window 3. The irradiation window 3 makes contact with the target holder 1, and therefore, the majority of heat is usually transferred to the target holder 1. In this embodiment, however, the heat that has been transferred to the irradiation window 3 mainly conducts in the direction of the thickness of the irradiation window 3 so as to be released to the air side. Accordingly, it becomes difficult for the heat that has been generated when the electron beam B strikes the target 2 and that has been transferred to the irradiation window 3 to be transferred to the X-ray tube (target holder 1) in this embodiment, which therefore is useful for X-ray tubes where it is necessary to take into consideration the thermal effects on the brazed portions and the O ring portions of the X-ray tube.

Figure 3:
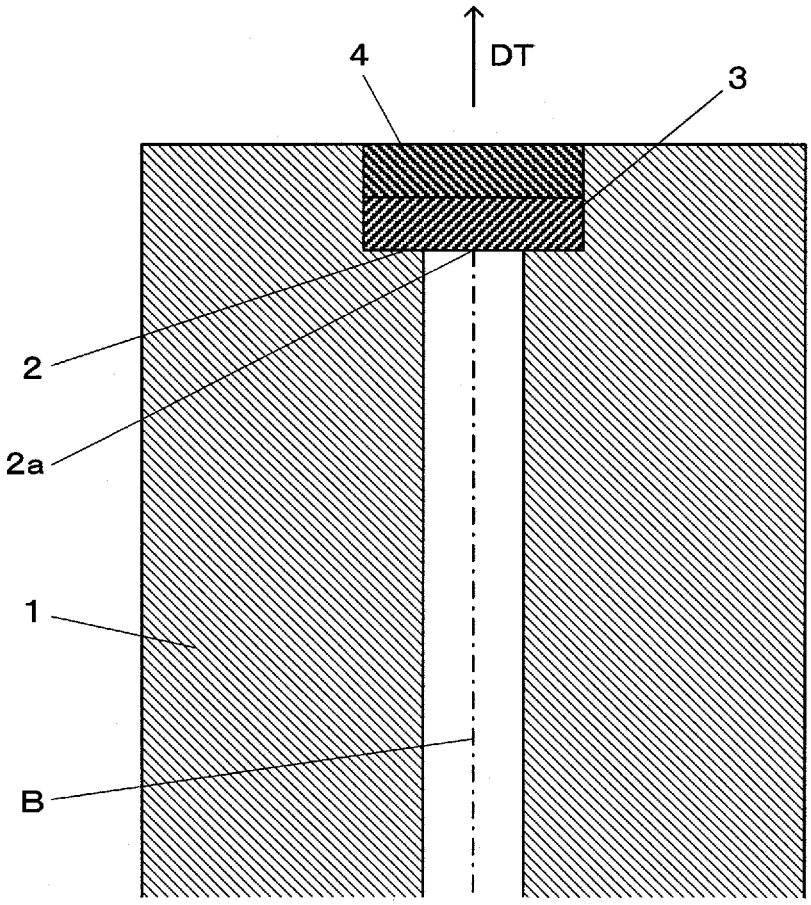
FIG. 3 is a schematic cross-sectional diagram showing the structure in the vicinity of the irradiation window of the X-ray tube where heat conduction to the target holder is suppressed according to another embodiment of the present invention.
Figure 4:
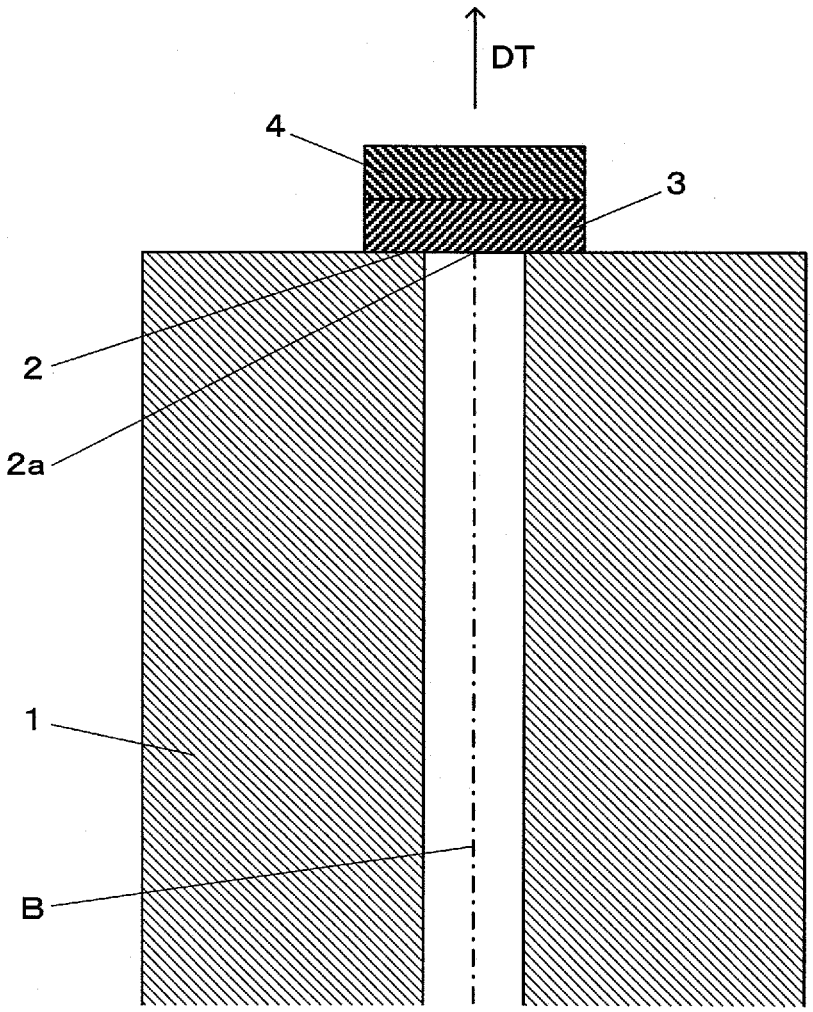
FIG. 4 is a schematic cross-sectional diagram showing a modification of FIG. 3.

In the above-described embodiment, as shown in FIG. 3, a metal layer 4, which allows heat to diffuse uniformly, may be provided on the surface of the irradiation window 3 on the air side for the purpose of preventing the temperature of the irradiation window 3 made of a thermally anisotropic material such as graphite from locally increasing. This metal layer 4 can be provided so as to protrude towards the air side as shown in FIG. 4, and in this case, heat is not transferred to the target holder 1 through the metal layer 4, and thus, heat can be efficiently released to the air side. The metal layer 4 can be made of Be, Al or the like.

Figure 5:
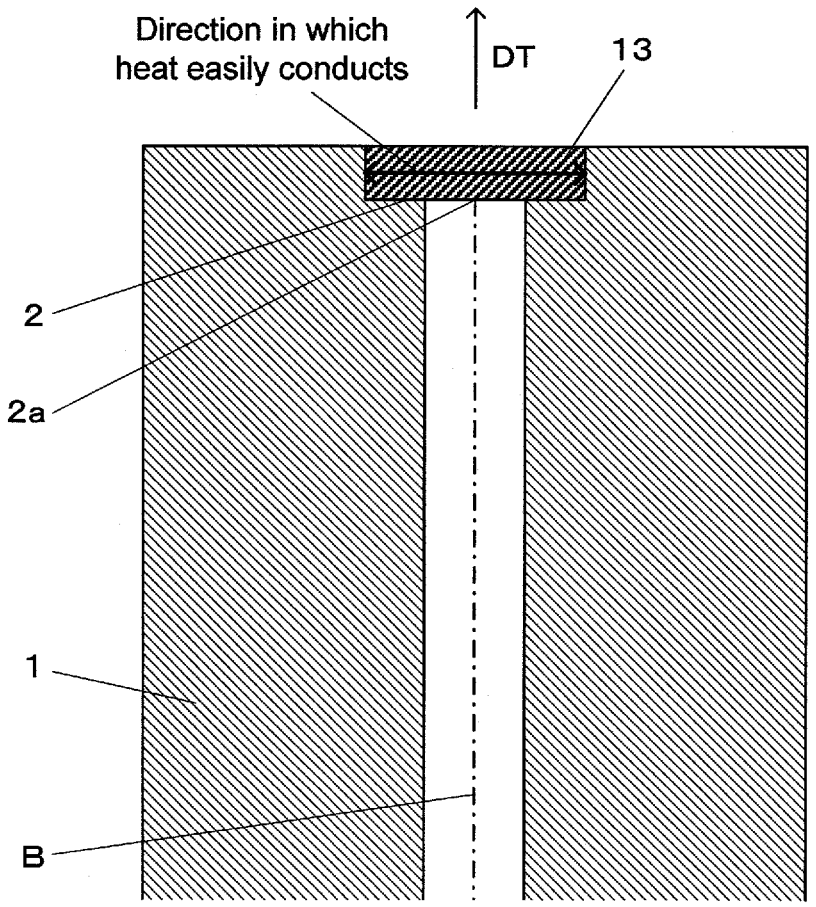
FIG. 5 is a schematic cross-sectional diagram showing the structure in the vicinity of the irradiation window of the X-ray tube where heat conduction to the air side is suppressed according to still another embodiment of the present invention.

FIG. 5 is a schematic cross-sectional diagram showing the irradiation window of the X-ray tube and its vicinity according to another embodiment of the present invention, which is an example of the structure for preventing heat from the irradiation window from being transferred to the air side. The structure illustrated in FIG. 5 is basically the same as in FIG. 1, and therefore, the same symbols are attached to the same members as in FIG. 1 and the descriptions thereof are omitted.

Figure 6:
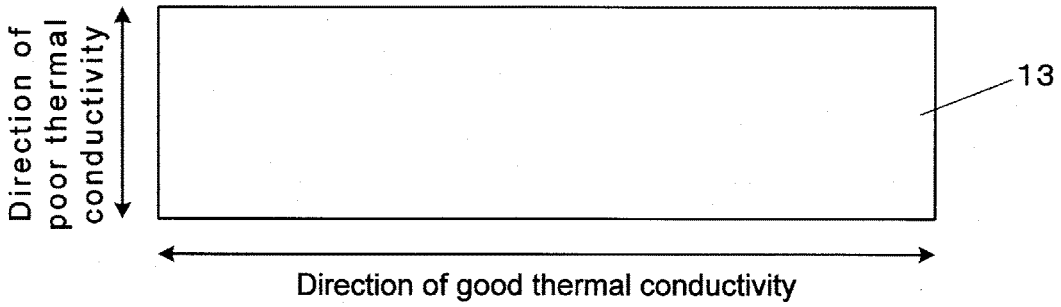
FIG. 6 is a diagram for illustrating away for heat to conduct through the irradiation window in FIG. 5.

In the example in FIG. 5, the irradiation window 13 is different from that in the example in FIG. 1. That is to say, though a thermally anisotropic material such as graphite as in FIG. 1 is used for the irradiation window 13 in the example in FIG. 5, the way for heat to conduct is characterized as shown in FIG. 6 in that the thermal conductivity in the direction in which the irradiation window 13 spreads (direction perpendicular to the electron beam B) is greater than the thermal conductivity in the direction of the thickness of the irradiation window 13 (the same direction as the electron beam B). Namely, the majority of the heat that has been transferred to the irradiation window 13 from the target 2 conducts in the direction in which the irradiation window 13 spreads.

As described in the example in FIG. 1, the heat on the target 2 that has been generated when the electron beam B strikes the target 2 is transferred to the irradiation window 13. In the example in FIG. 5, the heat in the irradiation window 13 mainly conducts in the direction in which the irradiation window 13 spreads, and thus, the amount of heat that is transferred from the irradiation window 13 to the air side can be kept low. Accordingly, it is difficult for the heat that has been generated when the electron beam B strikes the target 2 and that has been transferred to the irradiation window 13 to be transferred to the air side where an object to be inspected is placed in the example in FIG. 5. This is useful for X-ray generators where the thermal effects on an object to be inspected need to be taken into consideration when an image of the object needs to be taken with a high magnification ratio, that is to say, an X-ray image of the object needs to be taken when the object is as close as possible to the X-ray generating point (X-ray focal point) 2*a*.

Though in the example in FIG. 5 an irradiation window 13 where the thermal conductivity in the direction in which the window spreads is made greater than the thermal conductivity in the direction of the thickness of the window by using a thermally anisotropic material such as graphite, the same functions as those of the irradiation window 13 using an thermally anisotropic material can be provided in the case where an irradiation window having materials with different thermal conductivities that are layered on top of each other is used.

Figure 7:
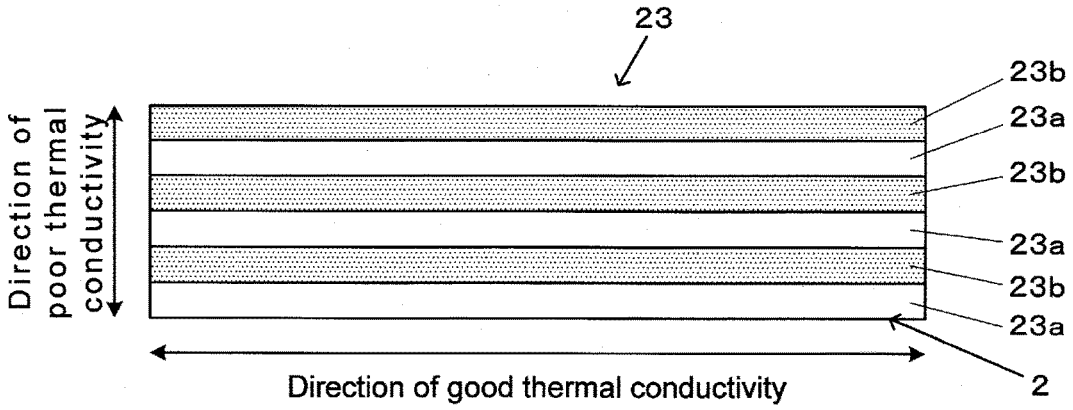
FIG. 7 is a diagram for illustrating the structure of the irradiation window made of a multilayer material having the same functions as the irradiation window made of a thermally anisotropic material in FIG. 5 and a way for heat to conduct through the irradiation window.

That is to say, as shown in FIG. 7, an irradiation window 23 made of a multilayer material where materials 23*a* with good thermal conductivity and materials 23*b* having poor thermal conductivity are alternately layered on top of each other may be replaced with the irradiation window 13 in FIG. 5 so that the same effects as in the example in FIG. 5 can be provided.

The irradiation window 23 in FIG. 7 has such a structure that a layer of a material 23*a* with good thermal conductivity is provided adjacent to the target 2 and a material 23*b* with poor thermal conductivity is provided next to the material 23*a*, which is then followed by repeatedly layering materials 23*a* and 23*b*. In this irradiation window 23, heat generated on the target 2 is transferred to the layers of the materials 23*a* with good thermal conductivity in such a manner that heat conducts uniformly within these layers. However, it is difficult for heat to be transferred to the adjacent layers of the materials 23*b* with poor thermal conductivity. That is to say, on the whole, heat easily conducts in the direction in which the layers spread while it is difficult for heat to conduct in the direction in which the layers are provided on top of each other in the multilayer body. In other words, the thermal conductivity in the (lateral) direction in which the irradiation window 23 spreads is greater than the thermal conductivity in the (longitudinal) direction of the thickness of the multilayer body, and thus, the same functions as of the irradiation window 13 made of a thermally anisotropic material in FIG. 5 are provided.

Here, examples of the materials 23*a* with good thermal conductivity used for the irradiation window 23 in FIG. 7 are light metals such as Be and Al, while SiO2 can be cited as an example of the materials 23*b* with poor thermal conductivity.

The degree of thermal anisotropy of the irradiation window according to the present invention is described below. A light metal is used for the conventional irradiation window according to the prior art in order to make X-rays transmit well, and the thermal conductivity of the irradiation window is approximately 100 to 300 W/(m·K). According to the present invention, it is desirable for thermal anisotropy to mean that the ratio of the greater thermal conductivity to the smaller thermal conductivity is at least 2 and possibly 10 or greater. In a preferable example, the thermal conductivity is 1000 W/(m·K) or greater in the direction in which the thermal conductivity is greater, and the thermal conductivity is 10 W/(m·K) or less in the direction in which the thermal conductivity is smaller.

Next, the effectiveness of the structure according to the embodiment in FIG. 5 and a simulation that was carried out in order to verify the effectiveness of the structure where the irradiation window in FIG. 5 was replaced with the multilayer body in FIG. 7 are described.

Figure 8:
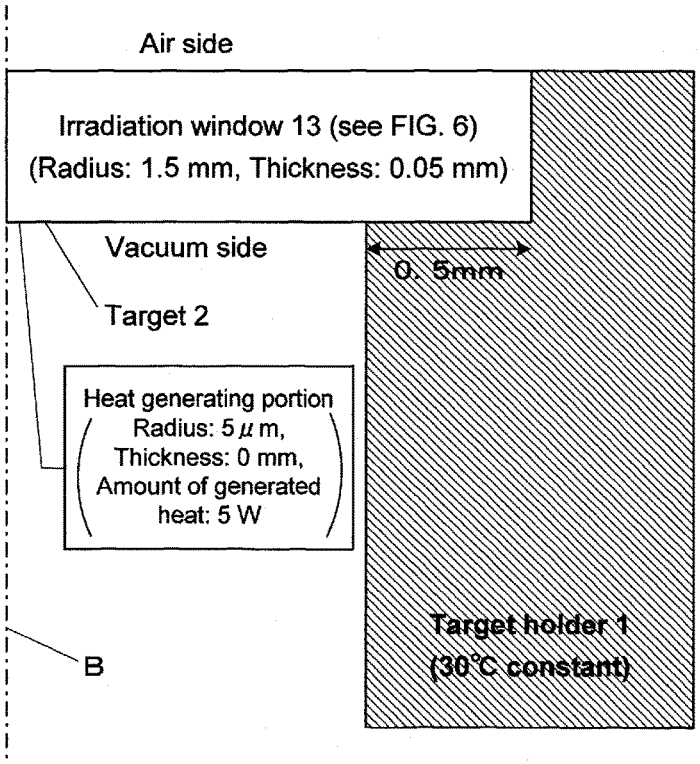
FIG. 8 is a diagram for illustrating a temperature simulation model for each portion when X-rays are generated in the embodiment in FIG. 5.

FIG. 8 is a diagram showing a model used for the simulation concerning the structure in the embodiment in FIG. 5. Since the actual structure is symmetric relative to the electron beam B, FIG. 8 is a cross-sectional diagram showing a half (right side) in the lateral direction. A simulation using this model was carried out on the basis of the finite element method as a verification test.

The irradiation window 13 has thermal anisotropy in the direction shown in FIG. 6, and the thermal conductivities used for the simulation were 1700 W/(m·K) in the direction in which the irradiation window 13 spread and 7 W/(m·K) in the direction of the thickness of the irradiation window 13. Another simulation on the irradiation window 13 (dimensions were the same as in FIG. 8) made of a thermally isotropic material with a thermal conductivity of 1700 W/(m·K) was carried out as a comparative example.

In the simulations, as shown in FIG. 8, heat was generated in an area having a radius of 5 μm at a point irradiated with an electron beam B until the amount of generated heat became 5 W, and thus, the temperature in each portion was calculated at the point in time when a state of thermal equilibrium was achieved. Table 1 shows the results of the calculations in temperature increments (° C.) on the vacuum side and on the air side along the axis of the electron beam B.

TABLE 1

| | Vacuum side | Air side |
|---|---|---|
| Isotropic material | 192° C. | 33.6° C. |
| Anisotropic material | 1955° C. | 10.0° C. |

As is clear from the results of the simulations, the temperature on the surface of the irradiation window on the air side could be lowered by 23.6° C. by using the thermally anisotropic material so that heat on the irradiation window mainly conducts in the direction in which the irradiation window spreads.

Figure 9:
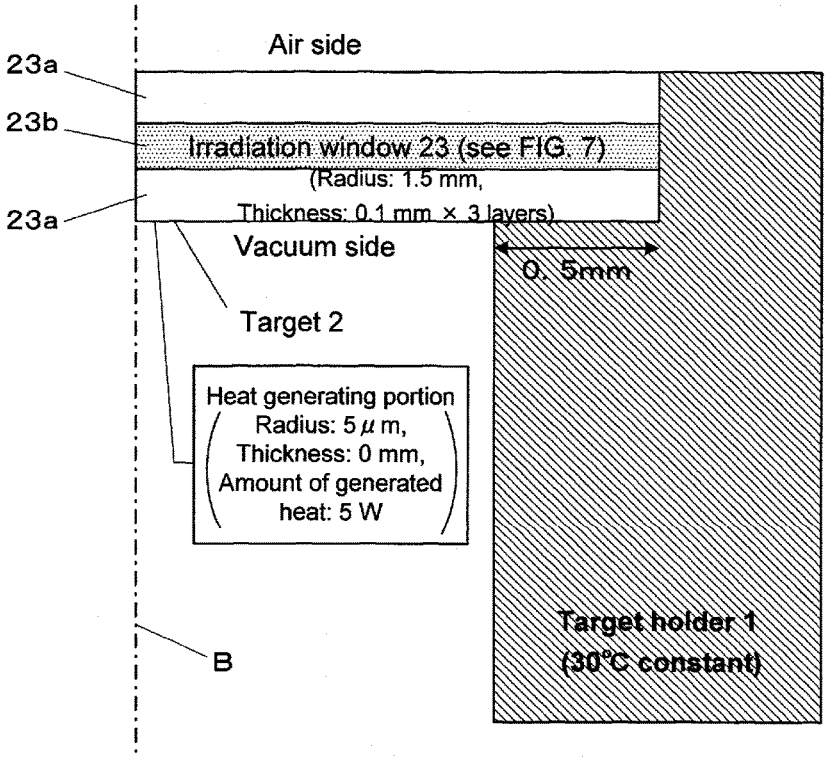
FIG. 9 is a diagram for illustrating a temperature simulation model for each portion when X-rays are generated in the case where the irradiation window in FIG. 7 is used.

FIG. 9 is a diagram showing a model used in a simulation where an irradiation window 23 having a multilayer structure as in FIG. 7 was adopted in place of the above-described thermally anisotropic irradiation window 13. This simulation model had the same structure as in FIG. 8 except for the irradiation window 23 and also had the same way of carrying out the simulation.

The irradiation window 23 had a three-layer structure where a layer of a material 23*b* with poor thermal conductivity was sandwiched between two layers of materials 23*a* with good thermal conductivity, where the thickness of each layer was 0.1 mm, the total thickness was 0.3 mm, the thermal conductivity of the materials 23*a* with good thermal conductivity was 100 W/(m·K), and the thermal conductivity of the material 23*b* with poor thermal conductivity was 5 W/(m·K). Another simulation was carried out as a comparative example in a case where the irradiation window 23 was a single layer (thickness: 0.3 mm) made of a material with a thermal conductivity of 100 W/(m·K) as a whole.

Table 2 shows the results of the calculations in temperature increments (° C.) at the point irradiated with the electron beam B at a point in time when a state of thermal equilibrium was achieved under the supposition that the same amount of heat was generated in the same area as in the model in FIG. 8.

TABLE 2

| | Vacuum side | Air side |
|---|---|---|
| Single layer | 2213° C. | 50.5° C. |
| Three layers | 2282° C. | 42.1° C. |

It can be seen from the results of the simulations that the temperature of the surface of the irradiation window 23 on the air side could be lowered by 8.4° C. in the case where the irradiation window 23 had a multilayer structure with thermal anisotropy.

Figure 11:
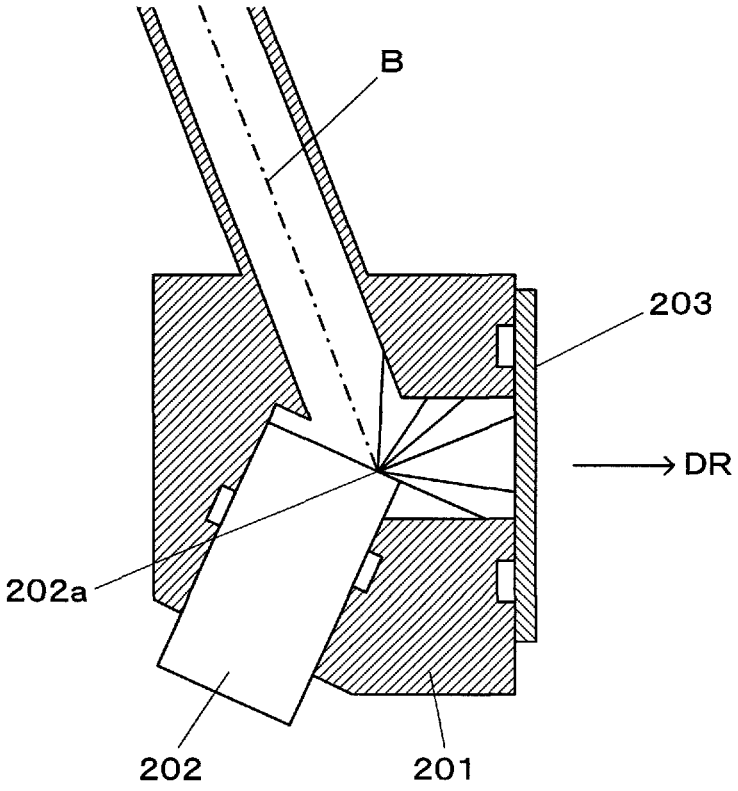
FIG. 11 PRIOR ART
FIG. 11 is a schematic cross-sectional diagram showing an example of the structure in the vicinity of the irradiation window of a reflection-type X-ray tube according to the prior art.

Though examples where the present invention is applied to a transmission-type X-ray tube are illustrated in the above, the present invention can be applied to the irradiation window of reflection-type X-ray tubes as in FIG. 11, and in this case as well, the same effects as those for the transmission-type X-ray tubes can be gained.

EXPLANATION OF SYMBOLS

1 Target holder
2 Target
3, 13, 23 Irradiation window
4 Metal layer
23*a* Material with good thermal conductivity
23*b* Material with poor thermal conductivity
B Electron beam

What is claimed is:

1. An X-ray generator for releasing X-rays generated by irradiating a target placed in a vacuumed atmosphere within an X-ray tube with an electron beam from an electron source to the outside of the X-ray tube through an irradiation window that air tightly seals an opening provided in said X-ray tube, characterized in that said irradiation window is formed of a thermally anisotropic material and has thermal anisotropy where the thermal conductivity is different between the direction in which the irradiation window spreads and the direction of the thickness of the irradiation window.

2. The X-ray generator according to claim 1, characterized in that the thermal conductivity of said irradiation window in the direction in which the irradiation window spreads is smaller than the thermal conductivity in the direction of the thickness of the irradiation window.

3. The X-ray generator according to claim 1, characterized in that the thermal conductivity of said irradiation window in the direction in which the irradiation window spreads is greater than the thermal conductivity in the direction of the thickness of the irradiation window.

4. The X-ray generator according to claim 1, characterized in that said thermally anisotropic material is graphite.

5. The X-ray generator according to claim 1, characterized in that a material of the target is layered on and integrated with a surface of said irradiation window on the vacuumed atmosphere side.

6. The X-ray generator according to claim 1, wherein a ratio of the thermal conductivity in a direction in which said irradiation window spreads to the thermal conductivity in a direction of the thickness of said irradiation window is two or greater.

7. The X-ray generator according to claim 1, wherein a ratio of the thermal conductivity in a direction in which said irradiation window spreads to the thermal conductivity in a direction of the thickness of said irradiation window is 10 or greater.

* * * * *